United States Patent [19]

Eggink et al.

[11] Patent Number: 5,006,752

[45] Date of Patent: Apr. 9, 1991

[54] ELECTRODELESS LOW-PRESSURE DISCHARGE LAMP

[75] Inventors: Hendrik H. J. Eggink; Winand H. A. M. Friedrichs; Adriaan Netten; Herman H. M. Van Der AA; Martin W. Schuiteman, all of Eindhoven, Netherlands

[73] Assignee: U.S. Philips Corporation, New York, N.Y.

[21] Appl. No.: 470,201

[22] Filed: Jan. 25, 1990

[30] Foreign Application Priority Data

Feb. 20, 1989 [NL] Netherlands ..... 89000406

[51] Int. Cl.[5] ..... H01J 1/50; H01J 65/04; H01J 61/00

[52] U.S. Cl. ..... 313/161; 313/34; 313/44; 313/45; 313/46; 313/493; 315/248

[58] Field of Search ..... 313/34, 44, 45, 46, 313/161, 493; 315/248; 335/300

[56] References Cited

U.S. PATENT DOCUMENTS

| | | | |
|---|---|---|---|
| 2,350,348 | 6/1944 | Gaugler | 174/15.2 |
| 4,536,675 | 8/1985 | Postma | 313/46 |
| 4,727,294 | 2/1988 | Houkes et al. | 313/493 |
| 4,727,295 | 2/1988 | Postma et al. | 315/248 |
| 4,728,867 | 3/1988 | Postma et al. | 315/248 |
| 4,927,217 | 5/1990 | Kroes et al. | 315/248 |

*Primary Examiner*—Donald J. Yusko
*Assistant Examiner*—Nimeshkumar Patel
*Attorney, Agent, or Firm*—Brian J. Wieghaus

[57] ABSTRACT

Electrodeless low-pressure discharge lamp having a discharge vessel which is sealed in a gastight manner and is filled with an ionisable metal vapor and a rare gas, which lamp has a cylindrical core of a magnetic material in which during lamp operation an electromagnetic field is generated in the discharge vessel by a metal wire winding surrounding the core and a high-frequency electric power supply unit connected thereto, the magnetic material core being provided with a cooling body consisting of a heat pipe which is located at the area of the longitudinal axis of the core and is surrounded by the core at least as far as the proximity of its first end, while the second end of the heat pipe is maintained at a relatively low temperature.

16 Claims, 1 Drawing Sheet

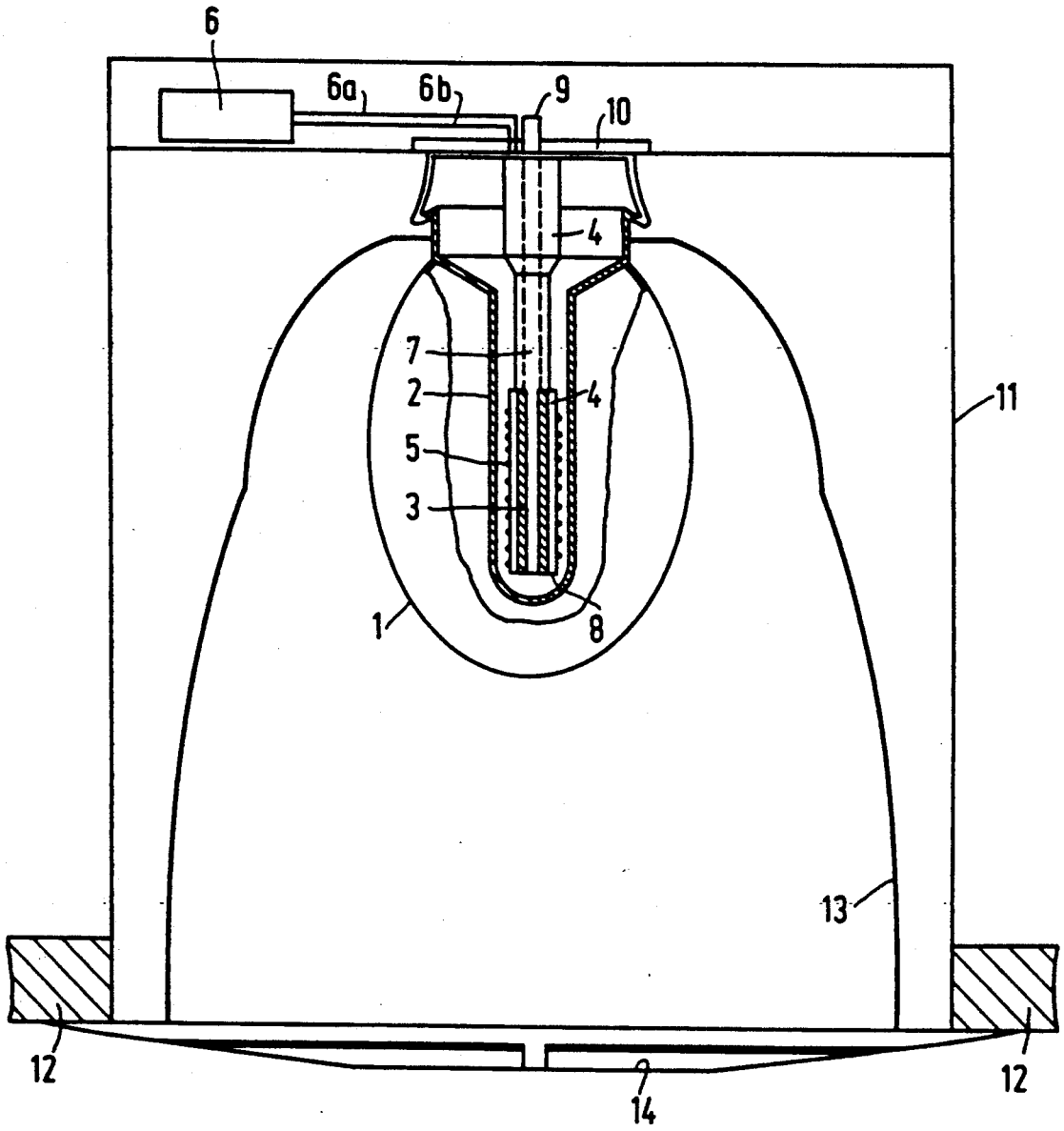
6
6a
6b
9
10
4
7
2
4
5
3
11
1
8
13
12
12
14

ELECTRODELESS LOW-PRESSURE DISCHARGE LAMP

BACKGROUND OF THE INVENTION

The invention relates electrodeless low-pressure discharge lamp having a discharge vessel which is sealed in a gastight manner and is filled with an ionisable metal vapour and a rare gas, the lamp having a cylindrical core of a magnetic material in which during lamp operation an electromagnetic field is generated in the discharge vessel by means of a metal wire winding surrounding the core and a high-frequency electric power supply unit connected thereto, the magnetic material core being provided with a cooling body. Such a lamp is known from U.S. Pat. No. 4,536,675.

In this known lamp a rod-shaped cooling body of, for example, copper is incorporated in the core of magnetic material (such as ferrite) so as to prevent the temperature of the magnetic core from rising to a too high value during operation. In fact, it has been found that there is a risk of an increase of the specific magnetic losses and a decrease of the magnetic permeability of the material when the core material becomes too hot during operation of the lamp. The light output of the lamp decreases due to the occurring power losses in the core. This phenomenon notably occurs if a relatively high power is applied to the lamp.

It has been found that the magnetic core material is insufficiently cooled by the solid rod in lamps to which a relatively high power is applied.

SUMMARY OF THE INVENTION

It is an object of the invention to provide an electrodeless low-pressure discharge lamp having a high light output when a relatively high power is applied to it and in which the above-mentioned thermal problems are avoided as much as possible.

According to the invention an electrodeless low-pressure discharge lamp of the type described in the opening paragraph is therefore characterized in that the cooling body is a heat pipe which is located at the area of the longitudinal axis of the core and is surrounded by the core at least as far as the proximity of its first end, while its second end is maintained at a relatively low temperature.

A high light output is realised with a lamp according to the invention. The conversion efficiency of electrical power into light has a high value, also when a relatively high power is applied (approximately 50 W or more). The high light output upon the applied high power is obtained because the core has a low temperature due to the presence of the thermal pipe. The heat pipe has a considerably lower thermal resistance than a solid metal body (such as a copper rod) which is present in the core of the known lamp. The cooling power of the heat pipe is higher and the increase of the temperature of the magnetic material of the core (such as ferrite) is considerably limited. The principle of a heat pipe is described in U.S. Pat. No. 2,350,348 and Philips Techn. Rev. 33, 1973, No. 4, pages 108–117 which publications are incorporated by reference herein. It has been found that in operation and at the said relatively high power the known )amp, whose core is provided with a solid metal rod, should have considerably larger dimensions so as to obtain the same light output and the same efficiency. This is not necessary in the lamp according to the invention. Therefore, the lamp according to the invention provides a wide field of application.

Due to the presence of the heat pipe, the temperature of the magnetic core is stabilised at a relatively low value because of the low thermal resistance of the heat pipe. The heat of the core is rapidly dissipated to a location outside the discharge vessel.

In a practical embodiment the lamp according to the invention is a fluorescent low-pressure mercury vapour discharge lamp. Preferably, the winding is present on the outer side of a synthetic material cylinder surrounding the core. It is achieved thereby that the temperature of this cylinder also remains relatively low. This provides a wide choice of synthetic material types to be used.

In a preferred embodiment the second end of the heat pipe is connected to a metal body (for example, a copper flange incorporating the second end with a press fit) by means of a connection having a low thermal resistance. The second end is then cooled to an optimum extent.

In a special embodiment, the metal body is secured to the wall of a metal housing which at least partly surrounds the discharge vessel of the lamp. Such a housing is also used as a heat sink and is, for example a thin-walled metal luminaire which may be, for example, countersunk in a ceiling. The advantage of such an embodiment is that the end of the heat pipe during lamp operation is maintained at a relatively low temperature by the metal housing.

In another embodiment a reflector is arranged between the outer wall of the discharge vessel and the wall of the housing. Light from the discharge vessel is formed to a beam by means of the reflector. Since the dissipation of heat via the heat pipe is optimum, the temperature of the hottest point of the magnetic core during lamp operation is reduced by more than 50% as compared with the known lamp. The use of synthetic materials in the discharge vessel (for example, the previously mentioned cylindrical synthetic material support for the winding or the reflector) is then possible.

The invention will be described in greater detail with reference to the accompanying drawing.

BRIEF DESCRIPTION OF THE DRAWING

This drawing shows diagrammatically an embodiment of an electrodeless low-pressure discharge lamp according to the invention, partly in an elevation and partly in a cross-section.

DETAILED DESCRIPTION OF THE INVENTION

The lamp has a slightly spherical glass discharge vessel 1 which is sealed in a gastight manner and is filled with mercury vapour and a rare gas. The inner wall of the discharge vessel is provided with a fluorescent coating for converting ultaviolet radiation generated in the discharge into visible light. A cylindrical indentation 2 is present in the wall of the lamp vessel at the location of its symmetry axis and is provided with a reflecting and a fluorescent coating. This indentation incorporates a cylindrical ferrite core 3 which is shaded in the drawing. A synthetic material cylinder 4 surrounds this core and its outer side has a metal wire winding 5. The two ends of this winding are connected via wires **6*a* and 6*b* to a high-frequency electric power supply unit 6 (shown diagrammatically) located outside the discharge vessel. A high-frequency electromagnetic field is generated in the discharge vessel by means of this power supply unit and the winding 5. The ferrite core 3 comprises a totally sealed heat pipe 7 at the area of its longitudinal axis, which pipe extends as far as the (first) end 8 of the core. The second end 9 of the heat pipe 7 is located outside the ferrite core. The part located outside the core is mainly surrounded by a part of the previously mentioned synthetic material cylinder 4**.

The second end 9 of the heat pipe is incorporated with a press fit in a metal flange 10 which is secured to the wall of a metal housing 11. This housing partly surrounds the discharge vessel 1, suppressing radio interference to an acceptable level. It is secured in a ceiling (12). A reflector 13' which is secured to the wall of the housing proximate to the flange 10, is arranged between this housing and the discharge vessel. The housing is closed by a grid 14 at the light exit side. The heat pipe comprises a part having a relatively large external diameter and a part having a relatively small external diameter. At the location where the thermal pipe is surrounded by the core (the evaporator part of the heat pipe), the outer diameter is smaller than outside the core (the condensor part). The evaporator part, however, still has such a surface area that the temperature remains high enough for the working fluid to evaporate and thus cool the core. However, the inner diameter of the heat pipe is equal throughout its length. Due to the high thermal load in the evaporator part of the heat pipe (i.e. the part surrounded by the core) water is preferably used as a fluid medium. A fine capillary structure in the heat pipe is also necessary. The capillary structure is necessary for a satisfactory operation of the heat pipe, notably in an operating position of the lamp in which the evaporator part is located above the condensor part (the condensor part is large enough so that its temperature during operation is low enough so that the water condenses). Copper is very suitable as a material for the heat pipe. The capillary structure is a fine-meshed gauze of phosphor bronze engaging the inner wall of the heat pipe. Due to the presence of this gauze the water in the heat pipe has a very low flow resistance and the wall is reliably moistened. Even if the lamp is operated in a position in which the evaporator part of the heat pipe is in a higher position than the condensor part, the gravitational force is sufficiently overcome.

Since the second end of the heat pipe is incorporated in the flange with a press fit a satisfactory dissipation of heat is ensured. Moreover, a low melting point tin solder is added to this compound for a satisfactory thermal contact. The flange itself (also consisting of copper) is dimensioned in such a way that the thermal resistance to the housing has a low value.

A lamp as shown in the drawing yielded approximately 6000 lumen in operation at 2.65 MHz and at a power consumption (inclusive of power supply) of 90 W. The efficiency of the system was therefore approximately 66 lm/W. The cylindrical magnetic core (ferrite, Philips 4C6) had an outer diameter of 12 mm. The winding surrounding the synthetic material cylinder had approximately 15 turns. The part of the heat pipe located in the ferrite core had an external diameter of 5 mm, and the other part had an external diameter of 6 mm. The internal diameter was 4 mm.

For a lamp operated at room temperature and at the above-mentioned power supply of 90 W the temperature of the ferrite core was approximately 120° C. In a known lamp having a copper rod operated under the same circumstances the ferrite had a temperature of more than 210° C. Due to the relatively low temperature of the core in the lamp according to the invention it is possible to use various synthetic materials for the cylinder 4. Moreover, it was found that the temperature of the glass wall at the area of the indentation was lower in the lamp according to the invention than in the known lamp.

We claim:

1. An electrodeless low-pressure discharge lamp having a discharge vessel which is sealed in a gastight manner and is filled with an ionisable metal vapour and a rare gas, said lamp having a cylindrical core of a magnetic material, means comprising a metal wire winding surrounding said core for generating an electromagnetic field in said discharge vessel during the lamp operation and a high-frequency electric power supply unit connected to said wire winding said magnetic material core being provided with a cooling body, characterized in that: said cooling body is a beat pipe which is located at the area of the longitudinal axis of the core and is surrounded by the core at least as far as the proximity of its first end, while its second end is maintained at a relatively low temperature.

2. An electrodeless low-pressure discharge lamp as claimed in claim 1, characterized in that said wire winding is present on the outer side of a synthetic material cylinder surrounding the core.

3. An electrodeless low-pressure discharge lamp as claimed in claim 2, characterized in that the second end of the heat pipe is connected to a metal body by means of a connection having a low thermal resistance.

4. An electrodeless low-pressure discharge lamp as claimed in claim 3, characterized in that the metal body is secured to the wall of a thin-walled metal housing which at least partly surrounds the discharge vessel.

5. An electrodeless low-pressure discharge lamp as claimed in claim 4, characterized in that a reflector is arranged between the outer wall of the discharge vessel of the lamp and the wall of the housing.

6. An electrodeless low-pressure discharge lamp as claimed in claim 1, characterized in that the second end of the heat pipe is connected to a metal body by means of a connection having a low thermal resistance.

7. An electrodeless low-pressure discharge lamp as claimed in claim 6, characterized in that the metal body is secured to the wall of a thin-walled metal housing which at least partly surrounds the discharge vessel.

8. An electrodeless low-pressure discharge lamp as claimed in claim 7, characterized in that a reflector is arranged between the outer wall of the discharge vessel of the lamp and the wall of the housing.

9. An electrodeless low-pressure discharge lamp as claimed in claim 2, characterized in that the metal body is secured to the wall of a thin-walled metal housing which at least partly surrounds the discharge vessel.

10. An electrodeless low-pressure discharge lamp as claimed in claim 9, characterized in that a reflector is arranged between the outer wall of the discharge vessel of the lamp and the wall of the housing.

11. An electrodeless low-pressure discharge lamp as claimed in claim 1, characterized in that the metal body is secured to the wall of a thin-walled metal housing which at least partly surrounds the discharge vessel.

12. An electrodeless low-pressure discharge lamp as claimed in claim 11, characterized in that a reflector is arranged between the outer wall of the discharge vessel of the lamp and the wall of the housing.

13. An electrodeless low-pressure discharge lamp as claimed in claim 4, characterized in that a reflector is arranged between the outer wall of the discharge vessel of the lamp and the wall of the housing.

14. An electrodeless low-pressure discharge lamp as claimed in claim 3, characterized in that a reflector is arranged between the outer wall of the discharge vessel of the lamp and the wall of the housing.

15. An electrodeless low-pressure discharge lamp as claimed in claim 2, characterized in that a reflector is arranged between the outer wall of the discharge vessel of the lamp and the wall of the housing.

16. An electrodeless low-pressure discharge lamp as claimed in claim 1, characterized in that a reflector is arranged between the outer wall of the discharge vessel of the lamp and the wall of the housing.

* * * * *